US007617682B2

(12) United States Patent
Bruck

(10) Patent No.: US 7,617,682 B2
(45) Date of Patent: Nov. 17, 2009

(54) CATALYTIC OXIDATION ELEMENT FOR A GAS TURBINE ENGINE

(75) Inventor: Gerald Joseph Bruck, Murrysville, PA (US)

(73) Assignee: Siemens Energy, Inc., Orlando, FL (US)

( * ) Notice: Subject to any disclaimer, the term of this patent is extended or adjusted under 35 U.S.C. 154(b) by 932 days.

(21) Appl. No.: 10/837,327

(22) Filed: Apr. 30, 2004

(65) Prior Publication Data

US 2005/0241313 A1 Nov. 3, 2005
US 2008/0110172 A9 May 15, 2008

Related U.S. Application Data

(63) Continuation-in-part of application No. 10/319,006, filed on Dec. 13, 2002, now Pat. No. 6,829,896.

(51) Int. Cl.
*F02C 1/00* (2006.01)
*F02G 3/00* (2006.01)

(52) U.S. Cl. ..... 60/723

(58) Field of Classification Search ..... 60/723, 60/777, 39.822; 431/7, 170
See application file for complete search history.

(56) References Cited

U.S. PATENT DOCUMENTS 3,859,786 A 1/1975 Azelborn et al.
3,928,961 A 12/1975 Pfefferle
3,938,326 A 2/1976 DeCorso et al.
3,943,705 A 3/1976 DeCorso et al.
4,067,190 A 1/1978 Hamm et al.
4,845,952 A 7/1989 Beebe
4,870,824 A 10/1989 Young et al.
5,826,429 A 10/1998 Beebe et al.
6,174,159 B1 1/2001 Smith et al.
6,339,925 B1 1/2002 Hung et al.
6,358,040 B1 3/2002 Pfefferle et al.
6,394,791 B2 * 5/2002 Smith et al. ..... 431/170
6,415,608 B1 * 7/2002 Newburry ..... 60/723
6,460,345 B1 10/2002 Beebe et al.
6,474,982 B2 11/2002 Satchell, Jr. et al.
6,588,213 B2 * 7/2003 Newburry ..... 60/777
6,619,043 B2 9/2003 Bruck et al.
6,625,988 B2 9/2003 Weisenstein et al.
6,658,856 B2 12/2003 Critchley
6,662,564 B2 * 12/2003 Bruck et al. ..... 60/723
6,748,745 B2 * 6/2004 Ul Karim et al. ..... 60/777
6,829,896 B2 * 12/2004 Bruck et al. ..... 60/723
6,923,001 B2 * 8/2005 Laster et al. ..... 60/723
2003/0056511 A1 * 3/2003 Bruck et al. ..... 60/723
2004/0112057 A1 * 6/2004 Bruck et al. ..... 60/723
2005/0011194 A1 * 1/2005 Laster et al. ..... 60/723
2005/0201906 A1 * 9/2005 Alvin et al. ..... 422/177
2006/0032227 A1 * 2/2006 Bruck et al. ..... 60/723
2006/0225429 A1 * 10/2006 Szedlacsek et al. ..... 60/777
2007/0000254 A1 * 1/2007 Laster et al. ..... 60/777
2007/0006595 A1 * 1/2007 Bruck et al. ..... 60/777
2007/0089417 A1 * 4/2007 Khanna ..... 60/723

* cited by examiner

*Primary Examiner*—William H Rodríguez

(57) ABSTRACT

A gas turbine engine (10) includes a catalytic oxidation element (62). The catalytic oxidation element includes a pressure boundary element (24) receiving a first fluid flow (16). An opening (28) in an upstream portion (26) of the pressure boundary element allows fluid communication across the pressure boundary element between the first and a second fluid flow (20) to generate a combustion mixture flow (30). A catalytic surface (34) disposed on a downstream portion (32) of the pressure boundary element is exposed to the combustion mixture flow for at least partially combusting the combustion mixture flow.

15 Claims, 4 Drawing Sheets

CATALYTIC OXIDATION ELEMENT FOR A GAS TURBINE ENGINE

CROSS-REFERENCE TO RELATED APPLICATION

This application is a continuation-in-part of U.S. application Ser. No. 10/319,006, filed Dec. 13, 2002, which issued as U.S. Pat. No. 6,829,896, on Dec. 14, 2004.

FIELD OF THE INVENTION

This invention relates to catalytic combustors in a gas turbine engine, and in particular, to a catalytic oxidation element premixing fuel and an oxidizer within the element.

BACKGROUND OF THE INVENTION

Catalytic combustion systems are well known in gas turbine applications to reduce the creation of pollutants in the combustion process. A typical gas turbine includes a compressor for compressing air, a combustion stage for producing a hot gas by burning fuel in the presence of the compressed air produced by the compressor, and a turbine for expanding the hot gas to extract shaft power. A catalytic combustion process may include premixing fuel with a portion of compressed air, and then partially oxidizing the resulting fuel/air mixture in the presence of a catalytic agent before passing the fuel/air mixture into the combustion stage. In some catalytic oxidation systems, a cooling scheme may be provided to control the temperature within the catalytic portion of the system to avoid temperature-induced failure of the catalyst and support structure materials. Cooling in such catalytic oxidation systems may be accomplished by using a technique known as backside cooling that includes passing a cooling agent over a backside of a catalyst-coated material.

U.S. Pat. No. 6,174,159 describes a catalytic oxidation method and apparatus for a gas turbine utilizing a backside cooled design. Multiple cooling conduits, such as tubes, are coated on the outside diameter with a catalytic material and are supported in a catalytic reactor module. A first portion of a fuel/air mixture is passed over the catalyst coated cooling conduits and is exothermically reacted, while simultaneously, a second portion of the fuel/air mixture enters the multiple cooling conduits and cools the catalyst. The exothermally catalyzed first portion then exits the catalytic oxidation system and is mixed with the second portion outside the system, creating a heated, partially combusted mixture.

BRIEF DESCRIPTION OF THE DRAWINGS

The invention will be more apparent from the following description in view of the drawings that show.

DETAILED DESCRIPTION OF THE INVENTION

Figure 1:
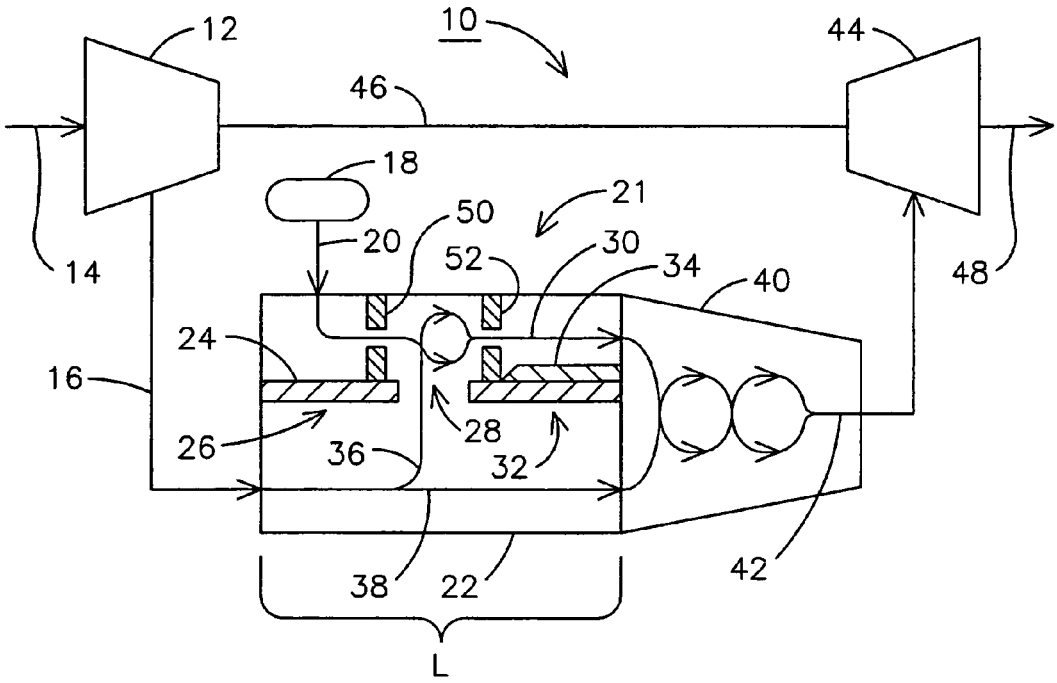
FIG. 1 is a functional diagram of a gas turbine engine having a catalytic oxidation module.

FIG. 1 is a functional diagram of a gas turbine engine 10 having a catalytic oxidation module. The gas turbine engine 10 includes a compressor 12, a combustor 21, and a turbine 44. The compressor 12 receives a flow of filtered ambient air 14 and produces a first fluid flow of an oxidizer, such as a flow of compressed air 16. In a backside cooling embodiment, the flow of compressed air 16 may be introduced directly into a catalytic oxidation module 22 within combustor 21, with or without mixing with a combustible fuel. A fuel source 18 may provide a second fluid flow, or flow of combustible fuel 20, for introduction into the catalytic oxidation module 22. Unlike conventional catalytic combustion techniques that require premixing of a fuel and with an oxidizer before introduction into the catalytic oxidation module 22, the flow of combustible fuel 20 may be introduced directly into the catalytic oxidation module 22 without mixing with an oxidizer. Advantageously, premixing of the fuel and oxidizer may be performed within the catalytic oxidation module 22 to eliminate the need for complex piping, fuel manifolding, and premixing chamber arrangements required in conventional catalytic oxidation techniques.

Inside the catalytic oxidation module 22, the flow of compressed air 16 and the flow of combustible fuel 20 are separated, for at least an upstream portion 26 of the travel length, L, by a pressure boundary element 24. An opening 28 in the pressure boundary element 24 allows fluid communication between the flow of compressed air 16 and the flow of combustible fuel 20 to allow mixing of the two flows 16, 20 and to generate a combustion mixture flow 30. For example, a first portion 36 of the flow of compressed air may pass through the opening 28 to an opposite side of the pressure boundary element 24 to mix with the flow of combustible fuel 20, while a second portion 38 of the flow of compressed air may continue on the same side, or backside, of the pressure boundary element 24 to provide backside cooling downstream of the opening 28. Advantageously, premixing of the flow of compressed air 16 and the flow of combustible fuel 20 may be achieved within the catalytic oxidation module 22. Baffle 50, disposed upstream of the opening 28, and optionally, baffle 52, disposed downstream of the opening 28, may be provided to regulate the flow of combustible fuel 20 and the combustion mixture flow 30 past the baffles 50, 52, respectively.

The combustion mixture flow 30 may be exposed to a catalytic surface 34, disposed on a downstream portion 32 of the pressure boundary element 24, for example, downstream of the opening 28, to partially oxidize the combustible fuel in the combustion mixture flow 30 in an exothermic reaction. The second portion 38 of the flow of compressed air flowing on the backside absorbs a portion of the heat produced by the exothermic reaction with the catalytic surface 34. Accordingly, the pressure boundary element 30 may be cooled by the second portion 38 of the flow of compressed air.

In an aspect of the invention, the pressure boundary element 24 may be coated with a catalytic material on the side exposed to the combustion mixture fluid flow 30. The catalytic material may include, as an active ingredient, precious metals, Group VIII noble metals, base metals, metal oxides, or any combination thereof. Elements such as zirconium, vanadium, chromium, manganese, copper, platinum, palladium, osmium, iridium, rhodium, cerium, lanthanum, other elements of the lanthanide series, cobalt, nickel, iron, and the like may be used. Other methods may be used to expose the combustion mixture flow 30 to the catalytic material, such as constructing a structure to suspend the catalytic material in the combustion mixture flow 30, constructing a structure from a catalytic material to suspend in the combustion mixture flow 30, or providing pellets coated with a catalyst material exposed to the combustion mixture flow 30.

After the flows 30, 38 exit the catalytic oxidation module 22, the flows 30, 38 are mixed and further combusted in a combustion completion stage 40 to produce a hot combustion gas 42. The hot combustion gas 42 is received by a turbine 44, where it is expanded to extract mechanical shaft power. In one embodiment, a common shaft 46 interconnects the turbine 44 with the compressor 12 as well as an electrical generator (not shown) to provide mechanical power for compressing the ambient air 14 and for producing electrical power, respectively. Expanded combustion gas 48 may be exhausted directly to the atmosphere, or it may be routed through additional heat recovery systems (not shown).

Figure 2:
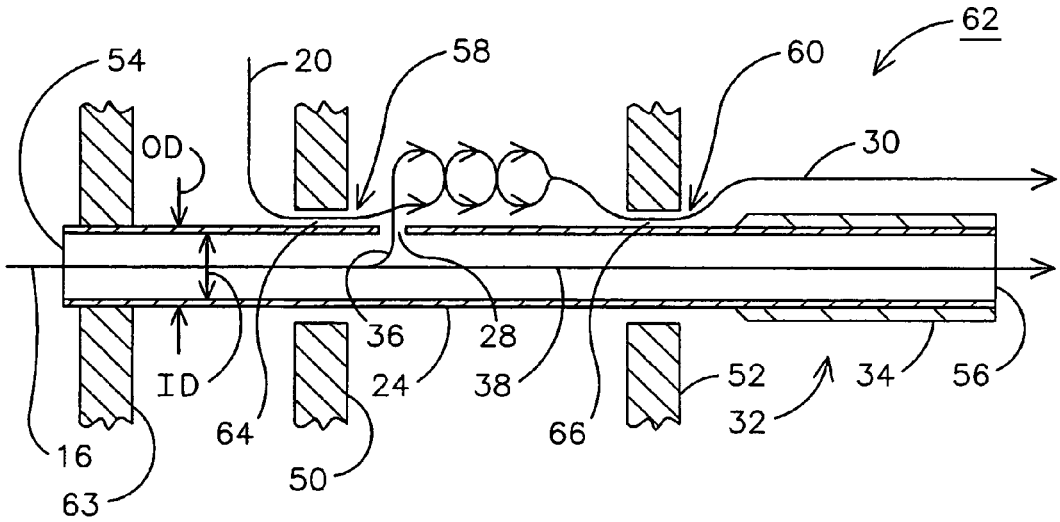
FIG. 2 is a longitudinal cross section view of an exemplary catalytic oxidation element of the catalytic oxidation module of FIG. 1.

FIG. 2 is a longitudinal cross section view of an exemplary catalytic oxidation element 62 of the catalytic oxidation module 22 of FIG. 1. In an aspect of the invention, the catalytic oxidation module 22 may contain one or more catalytic oxidation elements 62. Each catalytic oxidation element 62 may include a pressure boundary element 24, such as a tube having an inlet end 54 and an outlet end 56 for containing a fluid flow. The inlet end 54 of the tube may be connected to a support plate 63, such as a tubesheet, for retaining the tube. To provide a catalytic surface 34, the tube may be coated on its outside diameter (OD) along the downstream portion 32 with a catalytic material exposed to the combustion mixture flow 30 traveling around the exterior of the tube. In a backside cooling arrangement, the flow of compressed air 16 may be introduced into the inlet end 54 and directed to travel through the interior, or inside diameter (ID) of the tube, while the flow of combustible fuel 20 is directed around the exterior, or OD of the tube. The first portion 36 of the flow of compressed air may pass from the ID of the tube to the OD of the tube through an opening, such as opening 28, in the tube to mix with the flow of combustible fuel 20 flowing around the OD of tube. The direction of flow through the opening 28 may be controlled by adjusting the relative pressures between the flow of compressed air 16 and the flow of combustible fuel 20. The opening 28 may include a multitude of holes sized, shaped, and oriented to provide a desired fluid flow through the opening 28 to achieve, for example, a desired mixture ratio of the combustion mixture flow 30, such as 85% oxidizer and 15% combustible fuel. The second portion 38 of the flow of compressed air may continue to flow through the ID of tube to provide backside cooling downstream of the opening 28 until exiting at the outlet end 56.

In another embodiment, the flow of compressed air 16 may be directed to travel along the OD of the tube while the flow of combustible fuel 20 is directed to travel through the ID of the tube. The first portion 36 of the flow of compressed air 16 may pass through the opening 28 from the OD of the tube to the ID of the tube to mix with the flow of combustible fuel 20 flowing through the ID of tube to create the combustion mixture flow 30. Accordingly, the tube may be coated on the ID with a catalytic material to expose the combustion mixture flow 30 traveling therethrough. The second portion 38 of the flow of compressed air may continue to flow around the OD of tube to provide backside cooling downstream of the opening 28.

In an aspect of the invention, a baffle 50, positioned upstream of the opening 28, may be disposed in one or both of the flows 16, 20 to regulate the flows 16, 20 past the baffle 50. In another aspect, a second baffle 52 may be disposed downstream of the opening 28 to ensure, for example, that the combustion mixture flow 30 is evenly distributed through the catalytic oxidation module 22 downstream of the baffle 52. Each of the baffles 50, 52 may include passageways 58, 60 for allowing passage of the tube therethrough. The passageways 58, 60 may be sized sufficiently large to provide respective gaps 64, 66 around the tube to regulate a fluid flowing through the gaps 64, 66.

Figure 3:
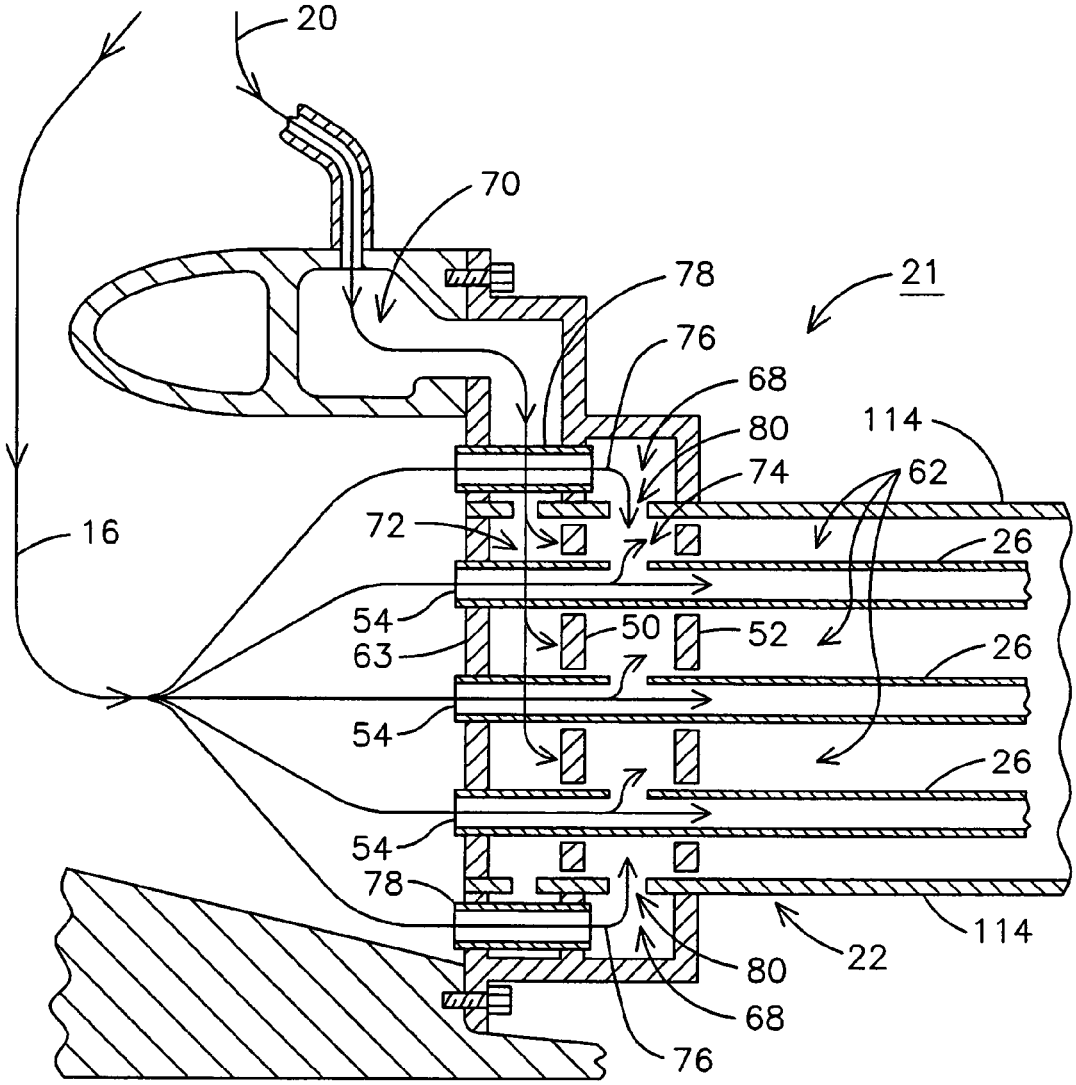
FIG. 3 is a longitudinal cross sectional view of an upstream portion of an exemplary combustor including a plurality of catalytic oxidation elements.

FIG. 3 is a longitudinal cross sectional view of an upstream portion of an exemplary combustor 21 including a plurality of catalytic oxidation elements 62 as described above. Collectively, the catalytic oxidation elements 62 may comprise the catalytic oxidation module 22. For example, the elements 62 may be assembled into a bundle, or tube array, contained within module walls 114 to form an easily replaceable catalytic cartridge. In an embodiment of the invention, the boundary element 26 comprising each of the catalytic oxidation elements 62 may be a tube retained at the inlet end 54 by the support plate 63. The flow of compressed air 16 may be directed to flow into the inlet ends 54 of each of the tubes. Optionally, the support plate 63 may include passageways (not shown) to allow a portion of the flow of compressed air to pass through the plate 63 into the catalytic module 22. In an aspect of the invention, the combustor 21 may include a manifold 70 in fluid communication with a space 72 defined between the support plate 63, such as a tubesheet, and the baffle 50. The fuel manifold 70 may receive the flow of combustible fuel 20 and discharge the flow of combustible fuel 20 into the space 72. The baffle 50 distributes the flow of combustible fuel 20 around each of the catalytic elements 62. The flows 16, 20 are allowed to mix and the resulting mixture is partially combusted as described above, for example, after passing the second baffle 52.

In yet another embodiment, an oxidizer manifold 68 in fluid communication with a second space 74 between the baffles 50, 52, may be provided to inject a portion 76 of the flow of compressed air 16 into the second space 74 through an opening 80 in the catalytic oxidation module. The opening 80 may be positioned and sized to regulate fluid flow therethrough in a desired manner. Furthermore, the flow through the opening may be controlled by adjusting the relative pressures between the flow of compressed air 16 and the flow of combustible fuel 20. A boundary element 78, such as a tube, may be provided to conduct the portion 76 of the flow of compressed air from an upstream side of the support plate 63 into the manifold 68 to bypass the first space 72. In an aspect of the invention, the manifold 68 may surround a periphery of the catalytic oxidation module 22 to inject the portion 76 of the flow of compressed air into the catalytic oxidation module 22 around the periphery. By supplying additional air via the oxidizer manifold 68, a pressure drop of the compressed air flowing through the module 22 may be reduced compared to a configuration having only openings 28 in the tubes.

Figure 4:
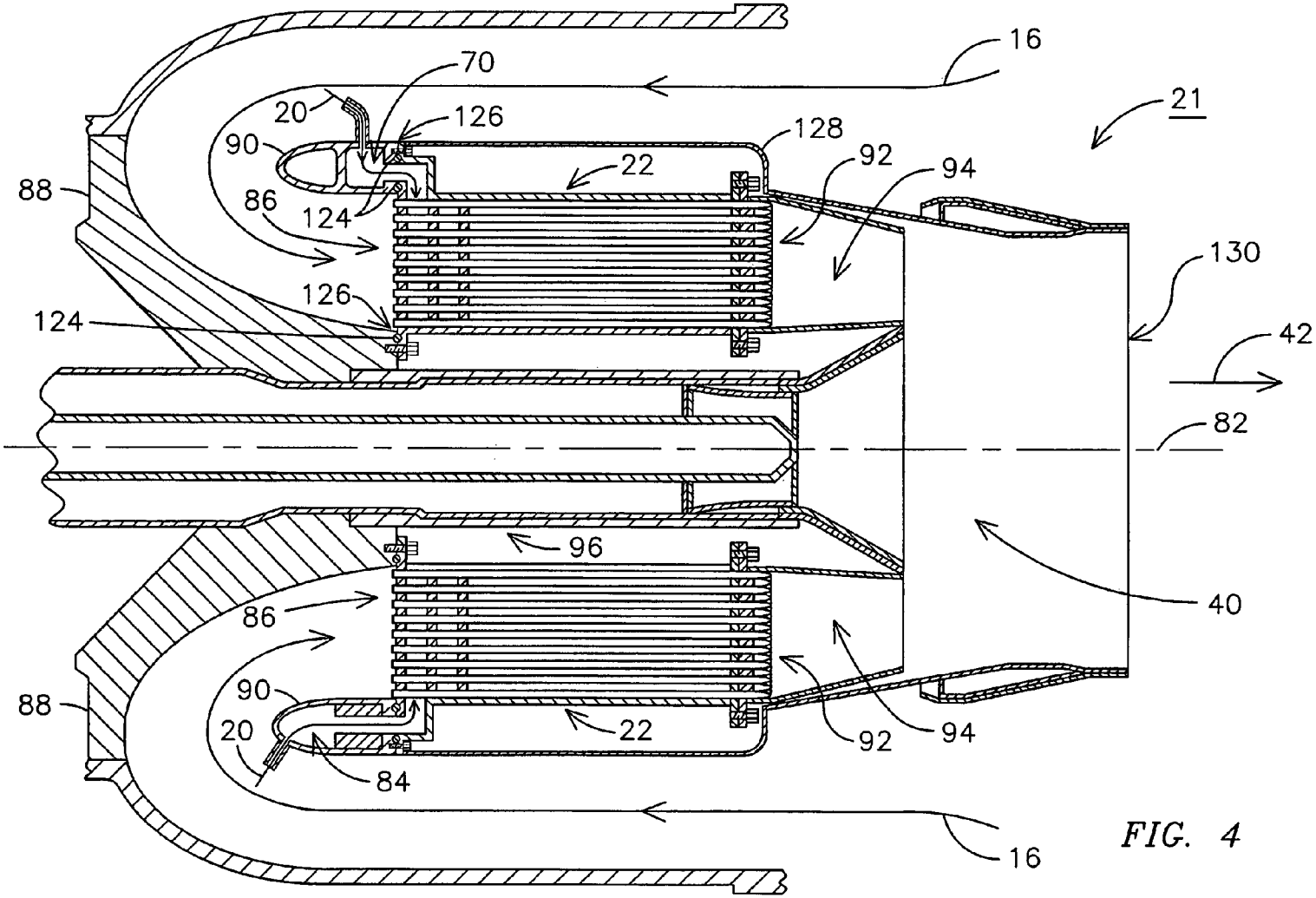
FIG. 4 shows a cross sectional view of an exemplary combustor having a multitude of catalytic oxidation modules circumferentially disposed about a central axis.

FIG. 4 shows a cross sectional view of an exemplary combustor 21 having a multitude of catalytic oxidation modules 22 circumferentially disposed about a central axis 82. As described previously, each catalytic oxidation element 62 in the module 22 may provide at least partial mixing of a portion of the flow of compressed air 16 and a portion of the flow of combustible fuel flow 20 and discharge a partially combusted mixture flow and a remaining portion of the flow of compressed air 16. The combustor 21 may include a first annular fuel manifold 70 circumferentially disposed radially outward of and proximate an inlet end 86 of the catalytic oxidation module 22. The first annular fuel manifold 70 may receive the flow of combustible fuel 20, and may be in fluid communication with all or a desired number of the catalytic oxidation modules 22 circumferentially disposed around the central axis 82. A second annular fuel manifold 84, for example, disposed upstream of the first manifold 70, may be in fluid communication with different ones of the catalytic oxidation modules 22 than the modules 22 in fluid communication with the first annular fuel manifold 70. Accordingly, staged fueling of the combustor 21 may be achieved by fueling the catalytic oxidation modules 22 connected to the first manifold to achieve partial combustion in these modules 22, then fueling the other catalytic oxidation modules 22 connected to the second manifold 84, for example, at a later time, to achieve partial combustion in these other modules 22. In an aspect of the invention, the fuel manifold 70 may be formed as an air turning element 90 having an exterior contour shaped to direct a flow of compressed air 16 around the air turning element 90, for example, in combination with a center support 88, and into the inlet ends 86 of the catalytic oxidation modules 22.

A mixing region 94 may be provided downstream of the respective exit ends 92 of each of the catalytic oxidation modules 22 to receive respective partially combusted mixture flows and compressed air flows discharged from the catalytic oxidation modules 22. The mixing regions 94 may be in fluid communication with a downstream combustion completion zone 40 for completing combustion to produce the hot combustion gas 42. In an aspect of the invention, a central pilot 96 may be disposed along the central axis 82, radially inward of the catalytic oxidation modules 22, for stabilizing combustion in the combustion completion zone 40.

Figure 5:
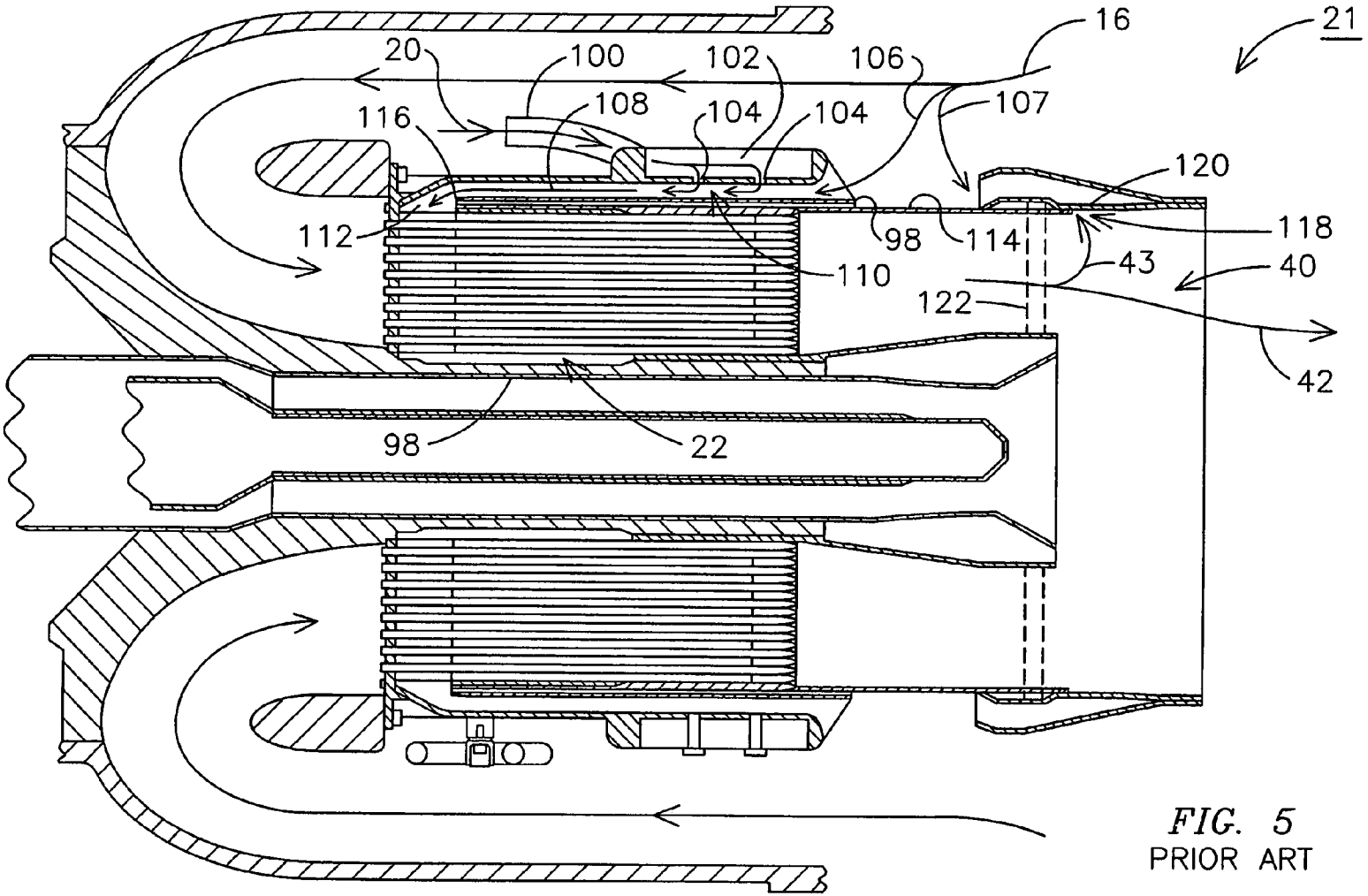
FIG. 5 PRIOR ART
FIG. 5 shows a cross section of a prior art combustor having a multitude of catalytic oxidation modules circumferentially disposed about a central axis.

FIG. 5 shows a cross section of a prior art combustor 21 having a multitude of catalytic oxidation modules 22 circumferentially disposed about the central axis 82. Each module 22 is retained within a housing 98 extending the length of the module 22 and surrounding the module 22. A flow of combustible fuel 20 is supplied to a manifold 102 via a fuel line 100. The fuel 20 passes through metering holes 104 and is premixed with a portion 106 of the flow of compressed air 16 to create a fuel/air mixture 108. The fuel/air mixture 108 travels though a fuel/air mixing conduit 110 and is discharged into the catalytic oxidization module 22 through an opening 112 in the module wall 114. Typically, a gasket 116 is used to seal a joint between the opening 112 of the fuel/air mixing chamber 110 and the module wall 114. Sealing of the joint effective to prevent leakage of fluids past the joint may require complex machining and may make assembly of the module 22 into the housing 98 difficult. In addition, sealing of a second joint 118 between a downstream end of the module wall 114 and the spring seal 120 to prevent a second portion 107 of the compressed air from leaking past the joint 118 and entering the combustion completion zone 40 (a condition that may potentially disrupt the combustion process) has typically required a complex gasketing arrangement, such as gasket 122, to prevent such leakage. Alternatively, the gasket 122 may be needed to prevent a portion 43 of the hot combustion gas 42 from leaking past the joint 118 and mixing with the flow of compressed air 16.

By innovatively providing mixing between the flow of combustible fuel 20 and the flow of compressed air 16 within each of the catalytic oxidation modules 22 as shown in FIG. 4, the need to provide a complex premixing arrangement of fuel lines, manifolds, mixing chambers, and gasketing arrangements may be reduced. As a result, the construction of the combustor 21 may be simplified compared to such conventional designs. For example, the module 22 may be simply connected, such as bolted, to a downstream end of the air turning element 90 and the center support 88. Support structures, such as the housing 98 used in the combustor shown in FIG. 5, may not be needed to support the modules 22. Gaskets 124, such as simple O-ring type gaskets, may be provided in a joint 126 between the air turning element 90 and the center support 88 to fluidically seal the joints 126.

In another aspect of the invention, a simple annular shell 128 may be disposed radially outward of the catalytic oxidation modules 22 and the combustion completion chamber 40 to seal, for example, the catalytic oxidation modules 22 and the combustion completion chamber 40 against entry of fluids, such as compressed air, except fluids directed into the inlet end 86 of each module 22. In addition, the annular shell 128 may seal around the combustion completion chamber 40 to prevent entry of any fluids not discharged from the catalytic oxidation modules 22 into the combustion completion chamber 40. In another aspect, the annular shell 128 may seal the combustion completion chamber 40 to prevent fluids, such as the hot combustion gas, from passing out of the combustion completion chamber 40 anywhere except from the combustion completion chamber outlet 130. Advantageously, gasketing of the joint 118 between the downstream end of the module wall 114 and the spring seal 120 that has been required in the past may be eliminated.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A catalytic oxidation element for a gas turbine engine comprising:

a pressure boundary element having an inlet end receiving a first fluid flow and an outlet end;

an opening in an upstream portion of the pressure boundary element allowing fluid communication across the pressure boundary element between the first fluid flow and a second fluid flow to generate a combustion mixture flow;

a catalytic surface disposed on a downstream portion of the pressure boundary element and exposed to the combustion mixture flow for at least partially combusting the combustion mixture flow;

a support plate connected to the inlet end of the pressure boundary element; and a first baffle disposed downstream of the support plate and upstream of the opening and comprising a first passageway allowing passage of the pressure boundary element therethrough, the first baffle further defining a first space between the support plate and the first baffle for distributing the second fluid flow;

wherein the pressure boundary element comprises a tube, wherein the opening is formed in the tube, and wherein the opening comprises a plurality of holes formed in the tube.

2. The catalytic oxidation element of claim 1, the first baffle further comprising a first gap around the pressure boundary element sized to regulate passage of the second fluid flow through the first baffle around the pressure boundary element.

3. The catalytic oxidation element of claim 1, further comprising a first manifold in fluid communication with the first space between the support plate and the first baffle, the first manifold receiving the second fluid flow and discharging the second fluid flow into the first space.

4. The catalytic oxidation element of claim 1, further comprising a second baffle, comprising a second passageway allowing passage of the pressure boundary element therethrough, the second baffle disposed downstream of the opening in the pressure boundary element, the second passageway defining a second gap around the pressure boundary element for regulating the second fluid flow past the second baffle.

5. The catalytic oxidation element of claim 4, further comprising a second manifold in fluid communication with a second space between the first and second baffles, the second manifold receiving a portion of the first fluid flow and discharging the portion of the first fluid flow into the second space.

6. The catalytic oxidation element of claim 5, further comprising a second boundary element conducting the portion of the first fluid flow from an upstream side of the support plate to the second space to bypass the first space.

7. The catalytic oxidation element of claim 1, wherein the first fluid flow comprises a cooling fluid.

8. The catalytic oxidation element of claim 7, wherein the cooling fluid contains no combustible fuel.

9. The catalytic oxidation element of claim 1, wherein the second fluid flow comprises a combustible fuel.

10. The catalytic oxidation element of claim 9, wherein the combustible fuel contains no oxidizer.

11. The catalytic oxidation element of claim 1, wherein the catalytic surface comprises a surface of the pressure boundary element.

12. A catalytic combustor for a gas turbine engine comprising:

a plurality of catalytic oxidation elements circumferentially disposed about a central axis, each catalytic oxidation element providing at least partial mixing of a first portion of a compressed air flow and at least a first portion of a combustible fuel flow to generate a combustion mixture flow and at least partially combusting the combustible fuel in the combustion mixture flow, each catalytic oxidation element discharging a partially combusted mixture flow and a second portion of the compressed air flow;

a first annular fuel manifold circumferentially disposed radially outward of and proximate to respective inlet ends of the catalytic oxidation elements, the first annular fuel manifold in fluid communication with at least some of the catalytic oxidation elements;

a combustion completion chamber disposed downstream of the catalytic oxidation elements receiving respective partially combusted mixture flows and compressed air flows discharged from the catalytic oxidation elements and discharging a hot combustion gas from an outlet end; and an annular shell disposed radially outward of the catalytic oxidation elements and completely surrounding the catalytic oxidation elements and the combustion completion chamber, the annular shell hermetically sealing the combustion completion chamber against passage of fluids not discharged from the catalytic oxidation elements into the combustion completion chamber and against passage of fluids not discharged from the outlet end out of the combustion completion chamber.

13. The catalytic combustor of claim 12, wherein the manifold further comprises an air turning structure for directing at least the first portion of the compressed air flow into respective inlet ends of the catalytic oxidation elements.

14. The catalytic combustor of claim 12, further comprising a second annular fuel manifold circumferentially disposed radially outward of and proximate to respective inlet ends of the catalytic oxidation elements, the second annular fuel manifold in fluid communication with different catalytic oxidation elements than the first annular fuel manifold to allow providing a second portion of the combustible fuel flow to the different catalytic modules.

15. A gas turbine engine comprising the catalytic combustor of claim 12.

* * * * *

UNITED STATES PATENT AND TRADEMARK OFFICE

CERTIFICATE OF CORRECTION

PATENT NO. : 7,617,682 B2
APPLICATION NO. : 10/837327
DATED : November 17, 2009
INVENTOR(S) : Gerald Joseph Bruck It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1601 days.

Signed and Sealed this

Nineteenth Day of October, 2010

David J. Kappos

David J. Kappos
*Director of the United States Patent and Trademark Office*